US005534196A

United States Patent [19]

Chapman et al.

[11] Patent Number: 5,534,196

[45] Date of Patent: Jul. 9, 1996

[54] PROCESS FOR MAKING LACTAM BLEACH ACTIVATOR CONTAINING PARTICLES

[75] Inventors: Benjamin E. Chapman; Michael T. Creedon, both of Cincinnati, Ohio

[73] Assignee: The Procter & Gamble Co., Cincinnati, Ohio

[21] Appl. No.: 350,089

[22] Filed: Nov. 29, 1994

Related U.S. Application Data

[63] Continuation-in-part of Ser. No. 173,308, Dec. 23, 1993, abandoned.

[51] Int. Cl.[6] ..... C11D 1/14; C11D 1/22; C11D 3/28; C11D 17/06

[52] U.S. Cl. ..... 252/186.27; 252/186.39; 252/186.25; 510/513; 510/220; 510/313; 510/376; 510/441; 510/500; 510/536

[58] Field of Search ..... 252/98, 186.3, 252/186.26, DIG. 2, DIG. 1, DIG. 7, 186.39, 186.31, 102, 174.13, 174, 186.27, 186.25, DIG. 4, 99, 554, 555, 556, 558, 559, 174.21, 174.14, 135, 524, 542, 544, 548

[56] References Cited

U.S. PATENT DOCUMENTS

| | | | |
|---|---|---|---|
| 4,126,573 | 11/1978 | Johnston | 252/99 |
| 4,207,199 | 6/1980 | Perner et al. | 252/174.13 |
| 4,290,903 | 9/1981 | Macgilp et al. | 252/91 |
| 4,321,157 | 3/1982 | Harris et al. | 252/174.25 |
| 4,399,049 | 8/1983 | Gray et al. | 252/91 |
| 4,422,950 | 12/1983 | Kemper et al. | 252/186.38 |
| 4,444,674 | 4/1984 | Gray | 252/95 |
| 4,486,327 | 12/1984 | Murphy et al. | 252/94 |
| 4,545,784 | 10/1985 | Sanderson | 8/107 |
| 4,547,305 | 10/1985 | Cornelissen et al. | 252/94 |
| 4,678,594 | 7/1987 | Parformak et al. | 252/186.31 |
| 4,726,908 | 2/1988 | Kruse et al. | 252/91 |
| 4,731,195 | 3/1988 | Olson | 252/174.13 |
| 4,853,143 | 8/1989 | Hardy et al. | 252/102 |
| 4,921,631 | 5/1990 | Gradwell et al. | 252/186.38 |
| 4,938,889 | 7/1990 | Wilsberg et al. | 252/102 |
| 5,015,408 | 5/1991 | Reuss | 252/99 |
| 5,112,514 | 5/1992 | Bolkan et al. | 252/99 |
| 5,211,874 | 5/1993 | Haendler et al. | 252/186.26 |
| 5,279,757 | 1/1994 | Gethoffer et al. | 252/95 |
| 5,334,324 | 8/1994 | Zeise et al. | 252/91 |
| 5,405,412 | 4/1995 | Willey et al. | 252/102 X |
| 5,405,413 | 4/1995 | Willey et al. | 252/102 X |
| 5,460,747 | 10/1995 | Gosselink et al. | 252/102 X |

FOREIGN PATENT DOCUMENTS

| | | | |
|---|---|---|---|
| 0376360 | 11/1989 | European Pat. Off. | C11D 3/395 |
| 0468824 | 7/1991 | European Pat. Off. | C11D 11/00 |
| 0356700 | 7/1989 | Germany | C11D 3/39 |
| 4024759 | 6/1992 | Germany | C11D 17/00 |
| WO92/13798 | 8/1992 | WIPO | C01B 15/00 |
| WO93/13194 | 7/1993 | WIPO | C11D 3/39 |

*Primary Examiner*—Douglas J. McGinty
*Attorney, Agent, or Firm*—Ken K. Patel; Jerry J. Yetter; Jacobus C. Rasser

[57] ABSTRACT

Acyl lactam bleach activator is intimately mixed with a water-soluble surfactant to form a bleach activator particle, with good solubility and which perhydrolyzes well. Said process does not include a drying step. Optionally, but preferably, the particle will further comprise binders and a crystalline material.

9 Claims, No Drawings

PROCESS FOR MAKING LACTAM BLEACH ACTIVATOR CONTAINING PARTICLES

CROSS-REFERENCE TO RELATED APPLICATION

This application is a continuation-in-part of application Ser. No. 08/173,308, filed Dec. 23, 1993now abandoned.

TECHNICAL FIELD

This invention relates to a process for preparing particulate bodies containing lactam bleach activator compounds, particularity caprolactams and valerolactams. Said caprolactam bleach activators are difficult or slow to solubilize and perhydrolyze in cool water (water temperature less than about 35° C.).

BACKGROUND OF THE INVENTION

It is well known that peroxygen bleaches are effective in removing stains and/or soils, as well as visible evidence of stains and/or soils, from textiles and fabrics. Unlike sodium hypochlorite bleaching solution, they can be readily employed in a variety of bleaching and detergent compositions. However, the efficacy of peroxygen bleaches can vary greatly with temperature. These bleaches are only practicable and/or effective when the bleaching solution (bleach and water mixture) is above about 60° C. When employed in a bleach solution at a temperature of about 60° C., or below, peroxygen bleaches are significantly less efficacious than at higher temperatures. Therefore, to obtain a desirable level of bleaching performance at these lower temperatures, extremely high levels of peroxygen bleach must be employed. Due to the cost of peroxygen bleach compounds, levels necessary to achieve good bleaching performance at such temperatures are economically impracticable. In bleach solutions where the temperature during use is well below 60° C., peroxygen bleaches are rendered almost totally ineffective regardless of the level of peroxygen bleach compound added to the system.

The dependence of peroxygen bleach performance on temperature (and concentration), described above, is both practically and economically significant. Peroxygen bleaches are most commonly used as detergent adjuvants in home laundry products. Thus, the typical textile wash process employing these bleaches utilizes an automatic household washing machine and a wash-water temperature below 60° C. As a consequence, there has been much interest in developing substances that would increase the efficacy of peroxygen bleach compounds allowing them to be effectively employed at a temperature below 60° C. and especially at temperatures less than about 35° C., typically used in hand-washing. Such substances are generally referred to in the art as bleach activators or peroxygen bleach activators.

Most of these prior art bleach activators are granular in character and are intended primarily as adjuncts to conventional laundry detergent granules. Such bleach activator granules conventionally comprise a bleach activator in admixture with a coating or carder material which serves to enhance the stability of the bleach activator and facilitates its uniform dispersion in the granular laundry detergent.

One such class of bleach activators which have been found to provide good bleaching of textiles and fabrics are the acyl lactam bleach activators, such as benzoyl caprolactam and benzoyl valerolactam. However, slow solubilizing lactam bleach activators such a benzoyl caprolactam can be difficult to use in granular laundry detergent compositions because they tend not to, solubilize/disperse satisfactorily in the wash water, especially at low wash water temperatures. The unsolubilized bleach activators may fail to be convened to peracids or precipitate on the fabrics in the wash where they then react with the peroxygen bleach and many times spot or remove color from the fabrics.

Still another problem in the manufacture of stable, soluble acyl lactam bleach activator particles is the relatively low melting point of some activators. Typically, methods for making bleach activator particles involve the use of water to form a mixture of the bleach activator with the other granule additives. After the granule additives and activator have been adequately combined, excess water must be removed, usually by some form of heat-assisted drying. Such drying processes for making acyl lactam bleach activators-containing particles are frequently inefficient because they require temperatures below the melting point of the bleach activators to preserve particle form and functionality.

The use of a liquid or molten surfactant intimately mixed with the bleach activator would seem to avoid the need for water in the process. However, because of the relatively low melting point of the acyl lactam activators, the choice of a suitable surfactant is limited. The surfactant should improve solubility of the activator. The surfactant should also allow the final granular product to be solid and non-sticky at room temperature (~20°–25° C.) and/or while the laundry product, which comprises the activator particle, is in storage where temperatures can reach 50°–55° C.

The present invention seeks, as one of its objectives, to resolve the problems of utilizing acyl lactam bleach activators in granule form by providing a stable matrix of materials in a particulate form that has satisfactory rate of solution/dispersibility and perhydrolysis characteristics, especially in cool wash water. The invention further seeks to provide a process which does not involve a drying step. Also, the invention seeks to provide bleach activator particles which are suitable for admixing into detergent formulations, i.e., they are non-sticky, have low friability and are free flowing.

BACKGROUND ART

U.S. Pat. No. 4,545,784, Sanderson, issued Oct. 8, 1985, discloses the adsorption of activators onto sodium perborate monohydrate.

U.S. Pat. No. 4,290,903, Macgilp, et al., issued Sep. 22, 1981, discloses a process for preparing granular bleach activator products. See also U.S. Pat. No. 4,444,674, Gray, issued Apr. 24, 1984, and U.S. Pat. No. 4,399,049, Gray et al., issued Aug. 16, 1983, and DE 4,024,759, Zeise. et al., issued Feb. 6, 1992.

SUMMARY OF THE INVENTION

The present invention relates to processes for preparing particulate bodies containing an acyl lactam bleach activator compound, or mixtures of such compounds, not including a heat-assisted drying step. A simplified process (I) comprises the steps of: (A) intimately mixing solid acyl lactam bleach activator compounds with a surfactant in liquid or deformable paste form at a temperature below the melting point of the bleach activator compounds. Said process is preferably substantially free of water. The product of said process is then formed into particles by agglomeration or extrusion.

The present invention also relates to a process (II) for preparing particulate bodies containing an acyl lactam bleach activator compound, or mixtures of such compounds, comprising the steps of: (A) intimately mixing solid acyl lactam bleach activator compounds with a composition in deformable paste form comprising a surfactant and water; (B) mixing the product of (A) with a crystalline material; and (C) forming the product of (B) into particles. A bleach activator-stable, water-soluble binder may be added in either step (A) or step (B).

In yet another mode, (III), the invention encompasses a non-aqueous process for preparing bleach activator particles, again without a heat-assisted drying process, comprising forming a co-melt of a substantially dry surfactant (typically, less than about 10%, preferably less than about 1%, by weight of water) and a caprolactam or valerolactam bleach activator, solidifying said co-melt by cooling, and forming the resulting solidified co-melt :into particles, e.g., by grinding, flaking, extruding, cutting or other convenient means. Thus, homogeneous melts comprising the lactam bleach activators and one or more of the preferred surfactants herein can be prepared at surfactant:lactam weight ratios of 10:1 to 1:10, solidified by chilling and formed into particles. (By "co-melt" herein is meant that the acyl lactam bleach activator is heated to a temperature above its melting point, and the surfactant is added to that melt and intimately admixed. At that temperature, the surfactant may or may not have reached its melting temperature. Of course, the temperature is not allowed to reach the decomposition temperature of either the lactam or the surfactant.) As desired, the particles formed from the co-melt may be agglomerated, typically by means of a binder, as in processes I or II, above.

DETAILED DESCRIPTION OF THE INVENTION

The present invention concerns a process (I), preferably continuous, for preparing particulate bodies containing one or more acyl lactam bleach activator compounds. Said activators can be difficult or slow to solubilize in cool water (below about 35° C.). Said process does not include a heat-assisted drying step and is preferably substantially free of water. Step A comprises intimately mixing one or more solid acyl lactam bleach activator compounds with a bleach activator-stable, water-soluble surfactant and, optionally, a water-soluble binder. Preferably, the surfactant is a liquid or deformable paste below the melting point of the activator or activators. By "substantially free of water" is meant the nonaqueous process reactants comprise less than about 2 wt. % of water. By "deformable paste" is meant a mobile pasty mass whose shape can be altered or changed by exerting a shear force to the mass (usually by hand pressure) and has a consistency similar to solid Crisco® or PlaydoughT. Step A has been found to improve solubility/dispersibility of the acyl lactam bleach activator-containing particulate bodies in wash water by increasing the rate of perhydrolysis. Following this step, particles are formed by agglomeration or extrusion.

The present invention also concerns a process (II) for preparing particulate bodies containing one or more acyl lactam bleach activator compounds. Said process comprises the steps of: (A) intimately mixing solid acyl lactam bleach activator compounds with a composition in deformable paste form comprising one or more surfactants and water (approximately in a 1:1 ratio); (B) mixing the product of (A) with a crystalline, bleach activator-compatible material; and (C) forming the product of (B) into particles. Optionally but preferably, a bleach activator-stable, water-soluble binder may be added in either step (A) or step (B). This process does not include a drying step.

Step (B) preferably includes mixing the product of step (A) with a crystalline, bleach activator-compatible, hydratable material at a temperature which is between 0° C. and the temperature of hydration of the hydratable material, until the product of (B) comprises less than 15 wt. %, preferably less than 10 wt. %, more preferably less than about 8 wt. %, of non-hydrated water. The hydratable, crystalline material acts to reduce the non-hydrated water level in the mixing step to the desired level for concentration in the product. By "temperature of hydration" is meant the temperature that the crystalline material will release hydrated or bound water. By "non-hydrated water", sometimes called "free water", is meant water in the product but which is not bound with the crystalline, bleach activator-compatible, hydratable material. The level of non-hydrated water in the product of step (B) can be determined by air drying the product sample at a temperature below the temperature of hydration of the crystalline material. The amount of non-hydrated water in the sample can be calculated from the difference in the weight of the sample before and after air drying. There can be additional steps inserted between the steps of this invention, e.g., additional mixing and/or extruding.

Preferably, the intimate mixture step (A) takes place in a high shear mixer, an extruder, or an extruder/mixer, most preferably in an extruder/mixer.

Preferably, the step in which the bleach activator/surfactant, binder, and crystalline, bleach activator-compatible material are mixed, step (B), takes place in a low or a high speed mixer. Examples include: V-blender with intensifier bar, pin mixers and/or plough share mixers. Most preferred is a pin mixer.

Preferably, step (B) takes place in a high speed mixer, like a Lodige CB. Preferably, the particle formation step (C), is accomplished by forming a granulate in a Turbolizer or a Lodige KM agglomerator or forming an extrudate in an axial or radial extruder, most preferably in a Fuji Paudal, axial or radial extruder. Alternatively, step (B) takes place in a low speed mixer, such as a Lodige KM, and step (C) takes place in other low speed mixer/agglomerators, known in the art. Particle forming in the Lodige KM can be accomplished by extended mixing in the same unit utilized for step (B), i.e., until the mixture, preferably, has less than about 10 wt. % of non-hydrated water and acceptable particles size is obtained. Because of the intimate surfactant mixing step, these particles have a good rate of solubility in the wash water.

A third optional ingredient for inclusion in step (B) mixing is process recycle (finished product return), which serves to improve process control.

The present invention concerns yet another process (III), for preparing particulate bodies containing one or more acyl lactam bleach activator compounds. Said process comprises the steps of (A) intimately mixing molten acyl lactam bleach activator compounds with one or more surfactants, which may or may not be molten themselves in this operation. Optionally, bleach activator-stable, water-soluble binder materials may be added to the molten mixture at this point. In step (B), the molten intimate mixture of acyl lactam, surfactant and optional binder material is cooled to a solidified mass. Finally, the cooling/solidified mass is formed into particulate matter suitable for admixing into detergent formulations by processes such as (but not limited to) grinding, flaking, agglomerating, extruding, sieving.

In the case wherein the optional water soluble binder materials are not added in step A, the cooled intimate mixture of acyl lactam and surfactant is ground into a fine powder, and a final particulate suitable for admixing into detergent formulations is prepared by agglomerating said ground fine powder utilizing a hot melted water soluble binder in an agglomeration process. Such agglomeration process is as described in the foregoing section, process (II) above.

In all process modes (I, II and III) an object of this invention is to provide a method of manufacture which does not involve the need for heat assisted drying. This, is important due to the low melting point sensitivity of the useful acyl lactam bleach activators described herein. Use of high temperatures desirable for efficient drying can cause melting and particle, stickiness or even particle deformation/destruction and must be avoided. On the other hand, use of low temperatures for drying are quite inefficient. Use of the processes of the present invention obviate the need for heat assisted drying entirely. Certain of the processes are non-aqueous, and thus require no drying. However, certain of the processes described herein allow the use of significant amounts of water (especially in surfactant pastes), which can also be handled without drying by utilizing the present techniques and teachings.

Acyl Lactam Bleach Activator

The processes of the present invention contain from about 10 to about 90, preferably from about 40 to about 80, most preferably from 50 to 80, weight % of solid acyl lactam bleach activators. The preferred ratio of bleach activator to surfactant in the intimate mixing step (A) is between about 100:1 and about 4:1, more preferably between about 50:1 and about 5:1, most preferably between about 10:1 and about 7:1.

The preferred acyl lactam bleach activators are solids at temperatures of about 70° C. and below. The following is a list of preferred lactam activators:benzoyl caprolactam, substituted benzoyl caprolactam, benzoyl valerolactam, substituted benzoyl valerolactam, and mixtures thereof.

Suitable caprolactam bleach activators are of the formula:

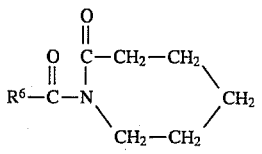

wherein $R^6$ is phenyl or a substituted phenyl group. Examples of substituted benzoyl caprolactams include 4-chlorobenzoyl caprolactam, 4-nitrobenzoyl caprolactam, 2-methylbenzoyl caprolactam, 2,4-dichlorobenzoyl caprolactam, pentafluorobenzoyl caprolactam, and mixtures thereof.

Suitable valerolactam bleach activators are of the formula:

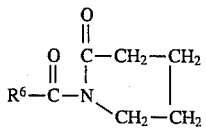

wherein $R^6$ is phenyl or a substituted phenyl group.

Methods for making lactams are well known in the art. Examples I and II, included below, illustrate preferred laboratory syntheses. Examples of substituted benzoyl valerolactams include 4-chlorobenzoyl valerolactam, 4-nitrobenzoyl valerolactam, 2-methylbenzoyl valerolactam, 2,4-dichlorobenzoyl valerolactam, pentafluorobenzoyl caprolactam, and mixtures thereof.

Contrary to the teachings of U.S. Pat. No. 4,545,784, cited above, caprolactam bleach activators are preferably not absorbed onto the peroxygen bleaching compound. To do so in the presence of other organic detersive ingredients could cause premature perhydrolysis, loss of activity and even safety problems.

Other agents for storage stabilization or exotherm control can be added to the bleach activator before incorporation into the final product. For example, buffers and chelants can optionally be included. Detergent compositions and bleaching compositions containing lactam bleach activators provide extremely effective and efficient surface bleaching of textiles. Stains and/or soils are removed from the textiles.

When the activators are used, optimum surface bleaching performance is obtained with washing solutions wherein the pH of such solution is between about 8.5 and 10.5 in order to facilitate the perhydrolysis reaction. Such pH is normally obtained with substances commonly added to detergent compositions, such as builders and alkaline materials, which are optional components of the bleaching systems herein. Such systems are useful not only for fabric laundering, but also in automatic dishwashing compositions.

Bleach Activator-Stable Detergent Surfactant

The particulate bodies of this invention also include bleach activator-stable, water-soluble detergent surfactants selected from the group consisting of anionics, nonionics, zwitterionics, ampholytics, and mixtures thereof. The preferred ratio of bleach activator to surfactant in the intimate mixing step is between about 100:1 and about 4:1, more preferably from between about 50:1 to about 5:1, most preferably from between about 10:1 to about 7:1. Anionic surfactant is preferred and salts of $C_{11-13}$ linear alkyl benzene sulfonate, $C_{12-16}$ alkyl sulfate and/or $C_{12}$-$C_{18}$ methyl ester sulfonates are more preferred. Sodium C 11-13 linear alkyl benzene sulfonate is most preferred. Preferably the surfactant in process modes I and II herein is liquid at temperatures below the melting point of the solid bleach activators, about 70° C. and below, or a deformable paste comprising surfactant and water (approximately 1:1 ratio of surfactant to water).

Nonlimiting examples of surfactants useful herein include the conventional $C_{10}$-$C_{20}$ soaps; $C_{11}$-$C_{16}$ alkyl benzene sulfonates; the $C_{12}$-$C_{18}$ primary and secondary alkyl sulfates and $C_{12}$-$C_{18}$ unsaturated (alkenyl) sulfates such as oleyl sulfate; the branched-chain $C_{10}$-$C_{18}$ alkyl sulfates; the $C_{10}$-$C_{18}$ alkyl ethoxy sulfates; the $C_{10}$-$C_{18}$ alkyl polyglycosides and their corresponding sulfated polyglycosides; the $C_{10}$-$C_{18}$ polyhydroxy fatty acid amides, especially the $C_{10}$-$C_{18}$ fatty acid amides of N-methyl through N-hexyl glucamine, see WO 9,206,154 and 9,206,984; $C_{12}$-$C_{18}$ alkyl methyl ester sulfonates (a-sulfonated fatty acid methyl esters); the $C_{10}$-$C_{18}$ alkyl ethoxy carboxylates; and oleoyl sarcosinate. The anionic sulfated and sulfonated surfactants are preferred. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the, water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$-$C_{18}$ carbon atoms) such as those produced by reducing the glycerides of tallow or coconut oil; and the sodium and potassium alkylbenzene sulfonates in which the alykyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched configuration, with from 3 to 12 moles of ethylene oxide per mole of alkyl phenol.

Preferred nonionics are the water-soluble condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing; from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Example of suitable "hard" nonionic suffactants that can be utilized as both surfactant and binder materials are polyethylene glycols, polyethylene oxide condensates of alkyl moieties, and polyethylene oxide condensates of alkyl phenols. Suitable polyethylene glycols are homopolymers of ethylene oxide having the general formula $HO(C_2H_4O)_nH$, having an average molecular weight of from about 2,000 to about 15,000, preferably from about 3,000 to about 10,000. Suitable polyethylene oxide condensates of alkyl moieties are of the formula $R\text{-}(C_2H_4O)_nH$, wherein R is $C_{10}$-$C_{18}$ and n is 20–100. Suitable condensation products of alkyl phenols have an alkyl group containing from 6 to 12 carbon atoms, in either a straight or branched chain configuration, with ethylene oxide. Such "hard" surfactants provide good solubility, which improves the rate of perhydrolysis of the bleach activator, and also provide suitable binding of the particles.

Bleach Activator-Stable, Water-Soluble Binders

The bleach activator particles of this invention optionally, but preferably, comprise bleach activator-stable, water-soluble binders. The materials that can be utilized as binders are polyethylene glycols, fatty acids, film-forming polymers, certain "hard" nonionic surfactants, and mixtures of these materials. Such binders should not be reactive with the bleach activators of the present invention. If the particles are placed in a detergent composition, the binder should not be reactive with the components of the detergent composition. Ideal binder materials have a low hygroscopicity upon storage but should be soluble or dispersible in water. This allows for dispersion and release of the bleach activator in the bleach or wash solution. It is also essential that the employed binder materials do not melt below about 50° C.–55° C. to avoid storage stability problems. Any melting of the binder during warm storage results in the particles becoming sticky and non-handleable.

The binder can be mixed with the bleach activator and surfactant during the early mixing stage step (A) or in a second step (B). The binder can be added as a hot melt or in an aqueous mixture. Alternatively, the binder can be dry added and mixed with the bleach activator or mixed with water before adding to the surfactant/bleach activator mixture.

Example of suitable "hard" nonionic surfactants that can be utilized as both surfactant and binder materials are polyethylene glycols, polyethylene oxide condensates of alkyl moieties, and polyethylene oxide condensates of alkyl phenols.

Suitable film-forming polymers useful as binder materials in the particles of the present invention are the polymers derived from the monomers such as vinyl chloride, vinyl alcohol, furan, acrylonitrile, vinyl acetate, methyl acrylate, methyl methacrylate, styrene, vinyl methyl ether, vinyl ethyl ether, vinyl propyl ether, acrylamide, ethylene, propylene and 3-butenoic acid.

Preferred polymers of the above group are the homopolymers and copolymers of acrylic acid, hydroxyacrylic acid, or methacrylic acid, which in the case of the copolymers contain at least about 50%, and preferably at least about 80%, by weight, units derived from the acid. The particularly preferred polymer is sodium polyacrylate. Other specific preferred polymers are the homopolymers and copolymers of maleic anhydride, especially the copolymers with ethylene, styrene and vinyl methyl ether.

Other film-forming polymers useful as binder materials include the cellulose esters such as carboxy methyl cellulose, hydroxyethyl cellulose, methyl cellulose, and hydroxypropyl cellulose.

Examples of other binder materials include sorbitan fatty acid esters selected from the group consisting of sorbitan monolaurate, dilaurate, trilaurate, monopalmitate, monostearate, distearate, tristearate, monooleate, dioleate, and trioleate, are preferred. Ethoxylated varieties of these compounds are also useful. For example, sorbitan esters having an average total level of ethoxylation of from about 4 to about 100, and preferably about 20 to about 85 moles of ethylene oxide per mole of sorbitan, are preferred. Also preferred binder materials include sorbitan monopalmitate, sorbitan monostearate, sorbitan distearate, and sorbitan tristearate.

Polyethylene glycols having an average molecular weight of from about 4,000 to about 8,000 are most preferred, as is a. $C_{12}$-$C_{14}$ ethoxylate having about 50 moles ethylene oxide per alkyl group. A mixture of lauric acid:PEG 8,000, in a weight:weight ratio of about 2:1 to about 1:2, more preferably about 1:1, is also preferred.

The level of binder material useful within the particles within the invention is from about 5% to about 25 wt. % of the body, more preferably from about 10% to lo about 25 wt. %.

The particles of the present invention may also contain all of the usual components of detergent compositions including the ingredients set forth in U.S. Pat. No. 3,963,537, Baskerville et al., incorporated herein by reference, so long as they are inert with respect to the bleach activator, suffactant, and binder material. Such components include other peroxygen bleach activators, color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzymes, enzyme stabilizing agents, perfumes, etc.

Crystalline, Bleach Activator-Compatible Material

The purpose of the crystalline, bleach activator-compatible material is to dilute the non-hydrated water level in the mixing step (step B) to a desired level for good particle formation, and to act as filler to achieve a desirable bleach activator concentration in the product. This material can be divided into hydratable and non-hydratable materials. It is preferably not film-forming material. Suitable non-hydratable materials include alumino-silicates and/or crystalline surfactants. Suitable hydratable materials preferably have a pH between about 5.0–8.0, most preferably between about 6.0–7.0. These are preferably selected from the group consisting of sodium sulfate, sodium acetate, sodium phosphate, sodium tripolyphosphate, sodium acid phosphite, lithium formate, lithium sulfate, zinc nitrate, and combinations thereof.

Preferred is sodium sulfate (most preferred). Materials to be avoided are halides and compounds containing heavy metals such as iron.

The approximate hydration temperatures of some of these materials are given below:

| | | |
|---|---|---|
| Sodium acetate | 136° F. | (58° C.) |
| Sodium phosphate | 94° F. | (35° C.) |
| Sodium acid phosphate | 108° F. | (42° C.) |
| Sodium sulfate | 90° F. | (32° C.) |

These hydratable materials are useful in processing the bleach activator containing particles of this invention and they add integrity to the final granule. The bleach activator-particles herein preferably comprise from about 10 to 95 weight % crystalline material.

The bleach activator particles made by the present invention can be used by themselves as a laundry bleach additive, but are preferably included in a conventional granular laundry detergent composition.

Preferred particulate bleaching compositions made according to this invention comprise:

(1) from about 10 to about 90 wt. % of one or more solid acyl lactam bleach activators; and (2) from about 1 to about 40 wt. % of surfactant selected from the group consisting of anionics, nonionics, zwitterionics, ampholytics, and mixtures thereof.

More preferred particulate bleaching compositions made according to this process comprise:

(1) from about 10 to about 90 wt. % of one or more solid acyl lactam bleach activators;

(2) from about 1 to about 40 wt. % of surfactant selected from the group consisting of anionics, nonionics., zwitterionics, ampholytics, and mixtures thereof, and (3) from about 5 to about 25 wt. % of binder selected from the group consisting of polyethylene glycols, fatty acids, film-forming polymers, certain "hard" nonionic surfactants, and mixtures thereof.

Most preferably, they comprise:

(1) from about 10 to about 90 wt. % of acyl lactam bleach activator;

(2) from about 1 to about 40 wt. % of surfactant selected from the group consisting of anionics, nonionics, zwitterionics, ampholytics, and mixtures thereof, (3) from about 5 to about 25 wt. % of binder selected from the group consisting of polyethylene glycols, fatty acids, film-forming polymers, certain "hard" nonionic surfactants, and mixtures thereof, and (4) from about 10% to about 95 wt. % of crystalline material.

Preferred are particulate laundry detergent compositions which preferably comprise from about 0.5 to about 40 wt. %, more preferably from about 1 to about 20 wt. %, of the particles produced by the present process.

Preferred Process

Step (A) Intimate Mixing

The lactam bleach activator is combined with a surface active agent, to aid in its solubility and improve the rate of perhydrolysis, through the use of an intimate mixing device. Without this step dissolution rates of the bleach activator particles have been found to be hindered, thus hurting overall performance in a washing environment. The preferred ratio of bleach activator to surfactant is about 10:1. The preferred surfactant is selected from the group consisting of $C_{11-13}$ linear alkyl benzene sulfonate, $C_{12-16}$ alkyl sulfate, $C_{12}$-$C_{18}$ methyl ester sulfonates, or mixtures thereof. The preferred intimate mixing device is a Teledyne-Readco Processor (extruder/mixer).

The Teledyne-Readco Processor is an intimate blending device (an extruder/mixer) with low residence time capabilities (less than about 30 seconds) but is capable of handling high viscosity, low water solids. It is preferably employed in the process to break down the bleach activator into small crystals, which has been found herein to maximize solubility, especially in cool water (less than about 35° C.). Secondly, and importantly, the bleach activator is intimately mixed in the extruder/mixer with preferred surfactant. This step coats much of the bleach activator crystal surface area to aid in the ultimate dispersibility and solubility of relatively insoluble bleach activators. The output of this intimate mixer is a highly viscous paste (similar to Crisco® or PlaydoughT). In processes which involve the addition of water, the free water content in the viscous paste is less than about 15%. (All of the water is "Free", non-hydrated).

The Readco is an axial, twin barrel processing device having various adjustable internal paddles. For use herein, these paddles may be configured in a number of ways to accomplish appropriate intimate mixing. Most useful combinations are double flat paddles in series, interspersed with helical paddles to force the bleach activator/suffactant paste mixture through the unit.

Surfactant and bleach activator are pumped and metered into the extruder/mixer, simultaneously, or alternatively, the surfactant may be added sequentially about half way down its barrel. Optionally, a binder may be added to either stream. The surfactant and bleach activator are fed at temperatures below the melting point of the bleach activator. The ratio of bleach activator to surfactant is typically 10:1 on an active basis.

If a deformable paste of water and suffactant is used in the process, the surfactant/water mixture is approximately 50% active and has a deformable/mobile paste-like consistency. The output of the Readco is a viscous paste which comprises approximately 9% water and which is ~75% active.

While the extruder/mixer increases the temperature of the mixture (via energy input), the resulting temperature of product only increases ~1° C. (~2° F.) above the product feed temperature due to cooling water in the barrel jacket of the extruder/mixer. This step produces a paste.

In non-aqueous systems, the bleach activator/surfactant is now ready for particle formation. Optionally a binder may be mixed with the bleach activator and surfactant in the above stage or in a second mixing stage.

Step (B) Mixing

The preferred method is to use a Lodige CB continuous mixer, which is preferably used to prepare a mixture of the product of step (A), binder, crystalline material (in processes which comprise the addition of surfactant/water deformable paste) and, optionally, process recycle for particle formation. The purpose of the mixer is three-fold: (1) provide an opportunity to reduce the free water of the step (A) paste to a level which is acceptable for particle formation (in the process which incorporates water in step (A)); (2) homogenize the paste, binder, crystalline material, and optional recycle components so that a homogeneous particle can be formed; and (3) offer sufficient residence time if or a portion of the non-hydrated water in the mixture, if present, to become hydrated by the hydratable, crystalline material. The streams entering the mixer are at a temperature below the melting point of the bleach activator. Residence time in the mixer is critical in achieving the desired level of hydration while ensuring the mixer does not overmix and form oversized agglomerates. The formation of what amounts to a homogeneous damp powder is preferred. The contents in the mixer should never reach or exceed the melting point of the bleach activator or of the hydration temperature for the crystalline material. To accomplish all these aspects of this mixing stage, both rotation speed and fill level should be properly controlled.

In the process which incorporates water in step (A), the "damp" powder discharge must have a free water level less than about 15% (most desired less than about 8%) for proper extrusion characteristics (preferred particle forming process—see step (C) below). In non-aqueous systems the mixture should be cooled to below the melting point of the binder. The cooled material can then be flaked and/or ground to the desired size (approximately 200–800 micron average). Alternatively, the cooled bleach activator/surfactant/binder mixture can be extruded and cooled, or agglomerated in a plough share mixer, such as a Lodige KM (preferred particle forming process—see step (C) below).

Step (C) - Particle Forming

The resulting product from step (B) should have less than about 15% water depending on the choice of aqueous or non-aqueous step (A) employed and on the particle formation equipment used. The preferred methods are to use either an agglomeration or extrusion process. In agglomeration, preferably a plough share mixer is used, such as a Lodige KM. In extrusion processes, a Fuji-Paudal continuous extruder, which forms the product produced in step (B) into cylinders of approximately 1 mm in diameter (hole diameter of die plate), is preferred. The purpose of the extruder is to form the bleach activator mixture into defined particles which can be handled, shipped and finally blended into a detergent. Finished particles should exhibit acceptable physical characteristics such as attrition resistance, low surface area per unit volume for stability optimization, acceptable rate of solubility, good perhydrolysis, aesthetically appealing color and acceptable flow characteristics, i.e., non-sticky and free flowing, and with sufficient structural integrity for formulation purposes.

Optional Step- Size Reduction

A COMIL basket type grinder is preferably used to size reduce agglomerated or extruded "overs" from the sizing operation. The output is blended with the "fines" and are returned as process recycle. They will enter the process at step (A)

Optional Step - Coating Operation

The "Save" component of the sizing operation can undergo a coating operation targeted at improving the flowability of the final particles. This is often desired to ensure bleach activator agglomerates or extrudates can be bulk stored, shipped and unloaded with ease. The coating can be a typical "free-flow" aid dry coating such as a silica powder or fine zeolite powder that can be applied in a typical mix drum.

The following examples illustrate the compositions and processes of the present invention. All parts, percentages and ratios used herein are by weight unless otherwise specified.

EXAMPLE I

Synthesis of Benzoyl Caprolactam - To a two liter, three necked round bottomed flask equipped with a condenser, overhead stirrer and 250 ml addition funnel is charged 68.2 g (0.6 moles) caprolactam, 70 g (0.7 moles) triethylamine and 1 liter of dioxane; the resulting solution is heated to reflux (120° C.). A solution of 84.4 g (0.6 moles) benzoyl chloride dissolved in 200 ml of dioxane is then added over 30 minutes, and the mixture is refluxed for a further 6 hours. The reaction mixture is then cooled, filtered, and the solvent removed by rotary evaporation to yield 121.7 g of the product as an oil which crystallizes on standing. This crude product is then redissolved in toluene and precipitated with hexane, yielding 103 g (79% theoretical yield) of a white solid which is shown by NMR to be over 95% pure, with the remaining material being benzoic acid.

EXAMPLE II

Synthesis of Benzoyl Valerolactam - To a 500 ml flask equipped with a condenser, overhead stirrer and 250 ml addition funnel is charged 0.12 moles valerolactam, 0.15 moles triethylamine and 150 ml toluene. The resulting solution is heated to 80° C., and a solution of 0.12 moles benzoyl chloride dissolved in 50 ml of toluene is added over 20 minutes. The mixture is refluxed for 6 hours with stirring. The reaction mixture is then cooled and filtered. The tiltrate is concentrated under vacuum to yield a brown solid which is recrystallized from toluene to yield 0.092 moles of benzoyl valerolactam. $^1$H NMR analysis shows the product to be greater than 95% pure. Analysis: $^1$H NMR (ppm). -1.9(M, 4H); 2.5(t,2H); 3.7(t,2H); 7.4(M, 5H). m(CM$^1$)-2925, 2856, 1686, 1673, 1458, 1287.

EXAMPLE III

Benzoyl caprolactam is synthesized and recovered according to the procedure in Example # 1.

Sample 3A- Approximately 162.5 grams of benzoyl caprolactam is combined with 5 grams dry $C_{12}$ AS surfactant and 35 grams of 50% active $NaC_{11-13}$ alkyl benzene sulfate (LAS) surfactant (in deformable paste form) at about 120° F. (49° C.). This combination is intimately mixed with pressure by hand mixing in a laboratory mortar and pestle into a creamy paste and is allowed to cool to ambient temperature (approximately 25° C.). Thus, the ratio of acyl lactam to dry active surfactant is 162.5:22.5, or about 7:1. The amount of water in this intimate mixture is about 17.5:202.5, or about 8.6%.

This mixture is placed into a small Braun Food Processor, Multiprac 280, along with 47.5 g. anhydrous Sodium Sulfate and mixed at medium speed for about 20 seconds to cause mixing of the dry sodium sulfate into the lactam/surfactant paste and eventual agglomeration and particle formation. The sodium sulfate acts as a hydrating agent, and hydrates a substantial amount of the free water in a short time. The amount of active bleach activator (benzoyl caprolactam) in this final mixture is 162.5 g. out of 250 g., or 65%.

Sample 3B - A second sample is prepared, wherein the ingredients and

Sample 3B - A second sample is prepared, wherein the ingredients and amounts are identical, but the order of addition is changed and there is no intimate premixing step. A dry mixture of benzoyl caprolactam, dry $C_{12}$AS and dry sodium sulfate are added to the Braun Food Processor and mixed. Then the warm, 50% active $NaC_{11-13}$ alkyl benzene sulfate (LAS) deformable paste is quickly added and all ingredients mixed as in sample 3 A. Mixing, agglomeration and particle formation occurs as in sample 3A. Again the sodium sulfate acts as a hydrating agent, and hydrates a substantial amount of the free water in a short time. The amount of active bleach activator (benzoyl caprolactam) in this final mixture is 162.5 g. out of 250 g., or 65%.

The granulations thus formed (Samples 3A and 3B) are sieved using multiple screen sizes to retain particles sized between 212–710 microns using a laboratory RoTap sieve shaker. The resulting particles are suitable for admixing into granular detergent formulations, and when subjected to a source of oxygen at a pH of about 10.5, perhydrolyze to form the peracid, perbenzoic acid, which is a useful bleaching agent in cool water, especially in handwashing situations.

Sample 3C - A third sample is prepared, wherein a simple dry mixture of benzoyl caprolactam and sodium sulfate is made in the Braun Food Processor and wherein the benzoyl caprolactam comprises 65% of the total weight. No surfactant is added to Sample 3C..

The three samples are tested for perhydroylsis rate using a standard testing method wherein a model detergent system comprising LAS, builders and sodium perborate are delivered to form an aqueous wash solution at a pH of about 10.5 and temperature of about 73° F. (23° C.). The percent of theoretical available oxygen (AvO) is measured versus time after the acyl lactam is added to the simulated wash solution. Table below shows the results, indicating significant improvement for the sample wherein the surfactant (LAS) is intimately mixed with the relatively hydrophobic benzoyl lactam.

| | % Theoretical Available Oxygen (AvO) | | |
|---|---|---|---|
| Time (minutes) | Sample 3A | Sample 3B | Sample 3C |
| 10 | 75.7 | 68.4 | 66.6 |
| 15 | 87.3 | 82.6 | 74.1 |

METHOD for AvO ANALYSIS

This method measures available oxygen (AvO) in detergent solutions, allowing determination of perhydrolysis rate of bleach activators. Potassium iodide reacts with the peroxide present to form free iodine which is titrated with sodium thiosulfate. There is a direct relationship between available oxygen in solution and the iodine created by the reaction, allowing an indirect analysis for oxygen in solution.

The analysis is performed with a METTLER DL-25 autotitrator. Other equipment required includes two and four place laboratory balances, magnetic stirrers, timer, general glassware, sampling syringes and an ice bath. The method has the ability to analyze both peracid AvO and total AvO. This is accomplished by the use of the enzyme catalase which destroys peroxide in solution, leaving only peracid for AvO measurement. A model detergent is used, which contains LAS, builders and sodium perborate (oxygen source).

| SAMPLE CONDITIONS (For Benzoyl Caprolactam) | |
|---|---|
| A) Test Temperature | 25° C./77° F. (±2° C. or ±3° F.) |
| B) Model Detergent Total Conc. | 3500 ppm (typical) |
| C) Molar Ratio, Bleach: Activator* | 3.5:1 |
| D) pH | 10.5 (±0.2) |
| E) Sampling Times: Peracid or Total AvO | As desired, usually including 10 & 15 min. |

*Bleach (oxygen source) is sodium perborate monohydrate. Activator concentration may vary.

Typical acyl lactam concentration is between 60–200 ppm.

ANALYSIS PROCEDURE

1) Normality of the sodium thiosulfate titrant is standardized daily against a potassium dichromate standard and installed into the METTLER DL-25 autotitrator. Plastic titration cups are prepared with catalase solution (0.005%) and placed in ice bath, one for each sample time.

2) Adjust continuously stirred model detergent solution at 25° C. to pH to 10.5 if needed with 10% NaOH. Add bleach activator, oxygen source (bleach) and start timer.

3)Peracid AvO Sampling and Analysis: Withdraw 25 ml samples of wash solution at appropriate time sequences.

a) Deliver each 25 ml sample into plastic titration cup (prepared in step 1).

b) Remove sample cup from the ice bath. Add 3N sulfuric acid and add 15% potassium iodide.

c) Attach sample cup to the DL-25 autotitrator and run preset method for iodimetric titration of oxygen (AvO analysis).

4) Total AvO Sampling and Analysis: Withdraw 10 ml sample of wash solution at appropriate time sequences.

a) Deliver each 10 ml sample into a plastic titration cup; add 20 ml of deionized water; add 3 drops of saturated ammonium molybdate solution; add 3N sulfuric acid and add 15% potassium iodide.

b) Attach sample cup to the DL-25 autotitrator and run preset method for iodimetric titration of oxygen (AvO analysis).

5) AvO results from the DL-25 titrator should be in ppm AvO. Titration calculation:

$$\text{ppm AvO} = \frac{8000 \times (\text{ml Titrant}) \times (\text{Normality of Titrant})}{\text{Sample weight}}$$

6) Report AvO results in terms of % theoretical AvO $$\%\ \text{theoretical AvO} = \frac{\text{AvO result from titration} \times 100}{\text{theoretical AvO}}$$

EXAMPLE IV

Benzoyl caproiactam is synthesized and recovered according to the procedure in Example # 1.

Non-aqueous pre-mix process (Samples A,B,C,D,F,G)

Dry, particulate mixtures comprised of benzoyl caprolactam, dry surfactants, organic binders, and processing aids are mixed together in beakers. Sample size is about 100 grams.

The dry blends are ground in a Braun coffee bean grinder for about one minute to give smaller particle size for more complete and intimate mixing.

Aqueous pre-mix process (Sample E)

An aqueous mixture comprised of benzoyl caprolactam particles, aqueous surfactant paste, organic binder, and processing agents are mixed together in beakers. Sample size is about 100 grams. It is thoroughly mixed with a spatula to make a uniform paste.

These dry and aqueous mixtures are placed individually into glass jars and sealed with lids. They are then heated to 140° F. (60° C.), which is below the melting point of the bleach activator benzoyl caprolactam, in a constant temperature room to equilibrate to 140° F. (60° C.). The mixtures are removed from the temperature room immediately prior to particle forming by extrusion and mixed with a spatula to insure they are still homogenous.

Extrusion process (All samples)

The mixtures are then extruded under force through a die plate comprised of a one millimeter opening. The extruder is heated to approximately 120° F.–135° F. (49° C.–57° C.) depending on the melting temperature of the binder, and mixture materials. The temperature of the mixtures and processing equipment is always lower than the melting point of the bleach activator.

The extrudates formed by this process are sized into lengths of 2 to 5 millimeters, preferably 1 to 2 millimeters. The extrudates can also ground into particles and sized through a sieve with 850 micron openings.

Typical formulations for the above described mixtures are as follows:

| | | TYPICAL FORMULATIONS - PARTS BASIS (W/W) | | | | | | |
|---|---|---|---|---|---|---|---|---|
| INGREDIENT | FUNCTIONALITY | A | B | C | D | E | F | G |
| Benzoyl Caprolactam | A | 80 | 75 | 75 | 75 | 75 | 75 | 75 |
| C12 Alkyl Sulfate (dry particles) | S | 7 | 9 | 12 | 7 | 0 | 7 | 7 |
| C12 Alkyl Sulfate (aqueous paste 28% conc.) | S | 0 | 0 | 0 | 0 | 25 | 0 | 0 |
| Palmitic Acid | P | 5 | 7 | 0 | 6 | 5 | 5 | 5 |
| Polyethelene glycol (molecular wt. 3350) | B | 8 | 9 | 13 | 7 | 8 | 8 | 7 |
| Tergitol 15-S-30 | B | 0 | 0 | 0 | 6 | 0 | 0 | 0 |
| Sokalan CP-5 | B | 0 | 0 | 0 | 0 | 0 | 5 | 0 |

-continued

| INGREDIENT | FUNCTIONALITY | TYPICAL FORMULATIONS - PARTS BASIS (W/W) | | | | | | |
|---|---|---|---|---|---|---|---|---|
| | | A | B | C | D | E | F | G |
| Neodol 45-13 | B | 0 | 0 | 0 | 0 | 0 | 0 | 6 |
| Na2SO4 | C | 0 | 0 | 0 | 0 | 5 | 0 | 0 |

Functionality Key:
A = Bleach Activator
S = Surfactant
P = Processing Aid
B = Binder
C = Crystalline Hydratable Material Tergitol 15-S-30 is a $C_{11}$-$C_{15}$ linear, secondary alcohol reacted with ethylene oxide with 30 moles of ethylene oxide ;per mole of alcohol made by Union Carbide. Sokalan CP-5 is a polyacrylate binder made by Hoechst. Neodol 45-13 is $C_{14}$-$C_{15}$ alkyl ethoxylate with 13 moles of ethylene oxide per molecule alkyl group made by Shell Chemicals.

Conclusions from Available Oxygen testing of these samples shows that as the amount of surfactant is increased in samples A, B and C, that perhydrolysis rate improves. All samples exhibit acceptable levels of solubility and perhydrolyze well.

EXAMPLE V

Benzoyl caprolactam is synthesized and recovered according to the procedure in Example # 1.

Samples 5 A and 5B

A dry mixture of Benzoyl caprolactam, 7.3 kg; a binder, Carboxy Methyl Cellulose (CMC), 400 g.; and sodium sulfate (500 g.) is prepared. Separately, a wet surfactant mixture is prepared comprising $NaC_{11-13}$ alkyl benzene sulfate (LAS), 600 g. of 50% active paste; $C_{12}$ alkyl sulfate ($C_{12}AS$), 1.2 kg dry powder; and water, 1925 g., and this second mixture heated to 120° F.

These two premixes are simultaneously continuously fed to a Teledyne-Readco extruder/mixer operated at slow speed, and intimately mixed through the barrel of the device. The dry feed rate is controlled to about 220 g/minute, and the warm fluid suffactant pumping rate is set to about 40 g./minute. No temperature control is exercised on the extruder, which operates at ambient temperature. Thus, the ratio of acyl lactam to dry active surfactant is about 12:1.

At the exit of the extruder/mixer a die plate comprised of circular holes having a diameter of ⅜ inch cause moist, similarly sized extrudates (or noodles) to be formed which are collected. The amount of acyl lactam in the wet noodles is about 75% and the total amount of water in this intimate mixture is about 9.2%. Noodles are collected during the course of the run, which is about 30 minutes, during which time samples are collected.

Sample 5A: A sample of the moist noodles is gently dried at about 100° F. (38° C.) and hand granulated.

Sample 5B: A sample of the moist noodles is added to a Braun Food Processor, Multiprac 280, and particles are formed by agglomeration at medium speed with addition a 100:1 wt/wt ratio of sodium sulfate: sodium alumino-silicate, such that the final particulate product contains about 50% active acyl caprolactam and total water content is about 6%. Alternatively, samples having identical compositions to sample 5B are made with the total amount of sodium sulfate (and silicate, if desired) incorporated into the dry mixture feed to the Teledyne-Readco extruder mixer, described above, and a dry, formed extrudate is made with excellent properties. Similarly, the binder material may be added to the wet surfactant mixture, if desired, without deviating from the scope of the invention.

Sample 5C

Approximately 162.5 grams of benzoyl caprolactam is combined with 17.5 grams dry carboxy methyl cellulose and 25 grams Neodol 45-7 (Shell Chemical Co. nonionic surfactant containing alkyl group of 14–15 carbon atoms and ethoxylated with 7 moles EO) at about 120° F. (49° C.). This combination is intimately mixed (as in Example #3 A) with pressure by hand mixing in a laboratory mortar and pestle into a doughy paste and allowed to cool to ambient temperature. This is a non-aqueous mixture.

This mixture is placed into a small Braun Food Processor, Multiprac 280, along with 15 grams anhydrous sodium sulfate and 30 grams sodium alumino silicate and mixed at medium speed for about 20 seconds (as in Example 3A) to cause mixing of the two crystalline materials into the lactam/surfactant/binder paste and eventual agglomeration and particle formation. The crystalline materials act as diluents and particle formation centers.

The granulations of samples 5A and 5B and 5C are sieved, sized as in Example #3. All resulting particles are suitable for admixing into granular detergent formulations and when subjected to a source of oxygen at a pH of about 10.5, perhydrolyze to form the peracid, perbenzoic acid, which is a useful bleaching agent in cool water, especially in hand-washing situations.

The three samples are tested for perhydrolysis rate using the "Method for AvO Analysis" previously described. Table below shows results of this testing indicating good AvO release for both the aqueous samples, dried (5A) and non-dried (5B) processes, and good AvO release for the non-aqueous process (5C), which also requires no drying.

| Time (minutes) | % Theoretical Available Oxygen (AvO) | | |
|---|---|---|---|
| | Sample 5A aqueous/dried | Sample 5B aqueous/nondried | Sample 5C non-aqueous/ non-dried |
| 10 | 85.2 | 88.7 | 69.1 |
| 15 | 91.9 | 90.2 | 88.3 |

The preferred particles prepared in the herein-described manner have a size in the range of from about 200 micrometers to about 1200 micrometers. The agglomerates are useful in laundry, bleach and automatic dishwashing compositions to augment the bleaching action of the so-called "per-bleaches" such as sodium perborate, sodium percarbonate, potassium persulfate, and the like.

EXAMPLE VI(A)

Benzoyl caprolactam is synthesized and recovered according to the procedure in Example I.

For each of the following samples, approximately 51 grams of benzoyl caprolactam is melted to a temperature of between 160°–185° F. (71° C.–85° C.) and approximately 9 grams of the surfactants described in the table below are added and intimately mixed for 1–2 minutes using a laboratory high shear tissue homogenizer (Janke and Kunkel Model SDT with a small capacity mixing head). In the samples wherein sodium sulfate is added this material is introduced in a subsequent step, and additional intimate mixing with the tissue homogenizer is completed. Following this step, approximately 38–39 grams of molten Polyethylene Glycol (MW 4000–8000) is added, and the resulting molten mass is again intimately mixed with the tissue homogenizer.

For each of the samples, the molten mass is transferred to separate 8"×12" glass Pyrex dishes, so that the thickness of the resulting molten material is approximately 2–5 mm. The dishes are then placed into a constant temperature room at 120° F. (49° C.) overnight. The following morning each sample dish is returned to ambient temperature conditions in the laboratory and allowed to cool further for approximately 1–3 hours. The cooled, solidified mass for each sample is removed by hand utilizing a stainless steel spatula. Removal is accomplished by "chipping out" irregularly shaped solidified chunks of material, most of which range in size from about 0.5 cm to about 5 cm. This solidified material is then ground into granular form using a Braun coffee bean grinder, or similar size reduction device. The particles are then screened using a Tyler 20 mesh screen (850 micron opening) and the particles passing through the screen opening are collected.

All particles comprising samples numbered A, B, C, D and E are tested for Available Oxygen according to the Method for AvO Analysis described in Example III herein, with the exception that temperature is 70° F. (2120 C.), the model detergent concentration is 1200 ppm, the weight ratio of bleach:activator is 1:1, and the pH is 10.2.

| Sample | Surfactant Description | Sodium Sulfate Used |
|---|---|---|
| A | Neodol 23-6.5T (Ethoxylated $C_{12-13}$ Nonionic) | 0 grams |
| B | $C_{12}$ alkyl sulfate (approx. 90% active) | 0 grams |
| C | $C_{16}$ secondary alkyl sulfate (approx. 90% active) | 0 grams |
| D | CFAS noodles (coconut fatty alkyl sulfate, approx. 90% active) | 4 grams |
| E | Sodium salt of $C_{16-18}$ fatty acid (base soap, approx. 85% active) | 4 grams |

| Results: % Theoretical Available Oxygen (AvO) | | | |
|---|---|---|---|
| Sample | 5 Minutes | 10 Minutes | 15 Minutes |
| A | 86.2 | 94.6 | 93.8 |
| B | 91.0 | 93.8 | 83.3 |
| C | 75.0 | 85.8 | 93.8 |
| D | 81.5 | 84.9 | 86.8 |
| E | 85.9 | 83.9 | 80.8 |

The AvO results from all the foregoing samples are acceptable.

EXAMPLE VI(B)

Benzoyl caprolactam is synthesized and recovered according to the procedure in Example I.

Stock Compound

An intimate mixture of benzoyl caprolactam and $C_{12}$ alkyl sulfate is prepared as follows: 150 parts (by weight) of benzoyl caprolactam is melted to a temperature between 175° F. and 200° F. (79° C. to 93° C.). To this, 16 parts (by weight) of $C_{12}$ alkyl sulfate powder (90–95% active) is added and again intimately mixed for 1–3 minutes using a laboratory high shear tissue homogenizer (Janke and Kunkel Model SDT, with a small mixing head).

The molten mass is transferred to 8"×12" glass Pyrex dishes, so that the thickness of the resulting molten material is 2–5 min. The dishes and molten material are allowed to cool at ambient laboratory conditions to stabilize at about 70° F.–75° F. (21° C.–24° C.). The solidified mass is removed by hand utilizing a stainless steel spatula. Removal is accomplished by "chipping out" irregularly shaped solidified chunks of material, most of which range in size from about 0.5 cm to about 5 cm. This solidified material is then ground into granular form using a Braun coffee bean grinder, or similar size reduction device. The particles are then screened using a Tyler 20 mesh screen (850 micron opening) and the particles passing through the screen opening are collected. These are identified as "accepts".

Agglomeration 83 parts (by weight) of the "accepts" from the stock sample of benzoyl caprolactam and $C_{12}$ AS are placed into a Kitchen-Aid Food Mixer bowl. A flat beater blade attachment is used to dry mix the particles( 1 to 2 minutes at medium speed) to break up any lumps present.

Next, 20 grams of a molten binder is slowly added to the above particles (about 10 minutes). This operation is conducted while the mixer with the flat beater blade attachment is running at a slow to moderate speed. The molten binder (a tallow alcohol ethoxylated to 25 moles ethylene oxide to one mole of alcohol) is added by warm transfer pipette in dropwise fashion.

Agglomerates of the benzoyl caprolactam/$C_{12}$AS particle and binder are formed as the binder cools from the molten to solid state. These agglomerates are sized by screen, and the portion passing through a Tyler 14 mesh screen (1180 micron opening), but retained on a Tyler 65 screen (212 micron opening) are collected.

The collected agglomerates are tested for Available Oxygen according to the Method for AvO Analysis described in Example VI(A). Results of this testing show that the particles display 67.5% Theoretical Available Oxygen (AvO) at 10 minutes time.

What is claimed is:

1. A process for preparing particulate bodies containing one or more acyl lactam bleach activator compounds, comprising the steps of (A) intimately mixing solid acyl lactam bleach activator compounds selected from the group consisting of substituted benzoyl caprolactam, benzoyl caprolactam, substituted benzoyl valerolactam, benzoyl valerolactam, and mixtures thereof with one or more surfactants in liquid or deformable paste form at a temperature below the melting point of the bleach activator compounds, wherein the weight ratio of the bleach activator compounds to the surfactants is between about 50:1 to about 5:1; (B) mixing the product of step A with from about 10% to about 95 wt. % of a crystalline hydratable material at a temperature which is between 0° C. and the temperature of hydration of the crystalline material to provide a damp powder comprising less than about 15 wt. % of non-hydrated water; and (C) forming the damp powder into particles wherein said process does not include a drying step.

2. A non-aqueous process for preparing bleach activator particles comprising the steps of: forming a co-melt of a substantially dry surfactant and a solid caprolactam or solid valerolactam bleach activator selected from the group consisting of substituted benzoyl caprolactam, benzoyl caprolactam, substituted benzoyl valerolactam, benzoyl valerolactam, and mixtures thereof at a temperature above the melting point of said activator, wherein the weight ratio of the bleach activator to the dry surfactant is between about 50:1 to about 5:1; solidifying said co-melt; and forming the resulting solidified co-melt into particles, wherein said process does not include a drying step.

3. A process according to claim 1 wherein step (A) further comprises mixing from about 5% to about 25 wt. % of a water-soluble binder with the bleach activator and surfactant.

4. A process according to claim 1 wherein :step (B) further comprises mixing the bleach activator/surfactant composition of step (A) with from about 5% to about 25 wt. % of a water-soluble binder.

5. A process according to claim 1 wherein the crystalline material is a silicate or a crystalline surfactant.

6. A process according to claim 2 wherein said particles are agglomerated by means of from about 5% to about 25 wt. % of a binder.

7. A process according to claim 1 wherein the crystalline material is selected from the group consisting of sodium sulfate, sodium acetate, sodium phosphate, sodium tripolyphosphate, sodium acid phosphite, lithium formate, lithium sulfate, zinc nitrate, and combinations thereof.

8. A process according to claim 1 wherein the surfactant is selected from the group consisting of anionic and nonionic surfactants, and mixtures thereof.

9. A process according to claim 8 wherein the surfactant is selected from the group consisting of sodium linear alkylbenzene sulfonate, $C_{12-16}$ alkyl sulfate, $C_{12}$-$C_{18}$ methyl ester sulfonates, ethoxylated alcohols and mixtures thereof.

* * * * *

UNITED STATES PATENT AND TRADEMARK OFFICE

CERTIFICATE OF CORRECTION

PATENT NO. : 5,534,196

DATED : July 9, 1996

INVENTOR(S) : Chapman et al.

It is certified that error appears in the above-identified patent and that said Letters Patent is hereby corrected as shown below:

In Column 1, line 60, change "carder" to -- carrier --.

In Column 2, line 2, delete ",".

In Column 2, line 4, change "convened" to -- converted --.

In Column 2, line 50, delete "." after "Zeise".

In Column 3, line 15, delete ":".

In Column 5, line 12, delete ",".

In Column 5, line 51, change "pentafiuorobenzoyl" to -- pentafluorobenzoyl --.

In Column 7, line 4, delete ",".

In Column 7, line 16, change "alykyl" to -- alkyl --.

In Column 8, line 12, delete ";".

In Column 8, line 29, change "suffactants" to -- surfactants --.

In Column 9, line 50, delete "lo".

In Column 9, line 56-57, change "suffactants" to -- surfactants --.

In Column 10, line 47, delete ".".

In Column 10, line 48, change "," after "thereof" to -- ; --.

In Column 10, line 59, change "," after "thereof" to -- ; --.

In Column 10, line 63, change "," after "thereof" to -- ; --.

In Column 11, line 40, change "suffactant" to -- surfactant --.

In Column 11, line 50, change "suffactant" to -- surfactant --.

In Column 12, line 10, change "if or" to -- for --.

In Column 13, line 36, change "tiltrate" to -- filtrate --.

In Column 16, line 9, change "caproiactam" to -- caprolactam --.

UNITED STATES PATENT AND TRADEMARK OFFICE

CERTIFICATE OF CORRECTION

PATENT NO. : 5,534,196

DATED : July 9, 1996

INVENTOR(S) : Chapman et al.

It is certified that error appears in the above-identified patent and that said Letters Patent is hereby corrected as shown below:

In Column 17, line 17, delete ";".

In Column 17, line 44, change "suffactant" to -- surfactant --.

In Column 20, line 16, change "min" to -- mm --.

In Column 21, line 21, delete ":".

Signed and Sealed this

Twenty-sixth Day of August, 1997

*Attest:*

Bruce Lehman

BRUCE LEHMAN

*Attesting Officer*

*Commissioner of Patents and Trademarks*